United States Patent [19]

Doucette et al.

[11] Patent Number: 4,562,782

[45] Date of Patent: Jan. 7, 1986

[54] MACHINE FOR FORMING FLY CONSTRUCTION

[75] Inventors: Eugene F. Doucette, Burlington, Mass.; Donald Richardson, Atkinson, N.H.; Joop F. Hoekstra, Medfield, Mass.

[73] Assignee: Reece Corporation, Waltham, Mass.

[21] Appl. No.: 535,714

[22] Filed: Sep. 26, 1983

[51] Int. Cl.[4] ..... D05B 3/12

[52] U.S. Cl. ..... 112/104; 112/121.15; 112/121.27; 112/113; 112/141; 112/147; 112/152

[58] Field of Search ..... 112/121.27, 121.26, 112/104, 113, 152, 147, 130, 136, 65, 121.15

[56] References Cited

U.S. PATENT DOCUMENTS

| | | | |
|---|---|---|---|
| 2,236,218 | 3/1941 | Marks | 2/234 |
| 2,393,292 | 1/1946 | Coates | 112/152 |
| 2,894,469 | 7/1959 | Van Amburg et al. | 112/136 |
| 3,263,238 | 8/1966 | Waldes | 2/265 |
| 3,765,348 | 10/1973 | Jabor et al. | 112/121 |
| 3,777,684 | 12/1973 | Friedman et al. | 112/121.27 X |
| 4,112,860 | 9/1978 | Ellington et al. | 112/147 X |
| 4,362,116 | 12/1982 | Sen Gupta et al. | 112/265 |

*Primary Examiner*—H. Hampton Hunter

[57] ABSTRACT

This invention relates to a machine for forming a fly structure in garments or the like and more particularly to a machine which folds a fly flap portion which is integral with the garment forming panel, then places a predetermined length of one half of a slide fastener stringer in position on the fly flap portion within the folds thus formed and secures the stringer to the folded flap portion.

28 Claims, 16 Drawing Figures

MACHINE FOR FORMING FLY CONSTRUCTION

BACKGROUND OF THE INVENTION

In the manufacture of garments, and more particularly trousers or the like, the most commonly used method to produce the fly structure is to utilize flypieces which are cut separately from the trouser front panels. One half of a slide fastener stringer is attached in a predetermined position on the fly piece and one edge of the flypiece is provided with overstitching or serging along one longitudinal edge. The other edge of the fly piece is then secured to the trouser front panel in the fly area to complete the installation of the fly flap and the slide fastener on the trouser front panel. The stitching of the slide fastener to the flypiece and the serging of the edge can be accomplished in one operation or in sequential operations.

In attaching the slide fastener stringers to the flypieces the usual method is to feed the flypieces one after another to a sewing machine and stitch them to a continuous length of slide fastener stringer. After the flypieces have been attached to the slide fastener, the slide fastener stringer is severed between the flypieces to provide independent flypieces each having a predetermined length of a slide fastener stringer attached thereto.

Attempts have been made to utilize front panels having the flypieces cut integral therewith. However this presents a problem in trying to utilize a continuous slide fastener stringer for attachment to the flypieces. The length of the leg portion makes it extremely difficult to attach the slide fastener stringer to the fly pieces closely following each other and then to separate the successive assemblies. Thus while machines have been utilized to automatically feed the small separate fly pieces and the slide fastener stringer to a sewing machine, the feeding of fly pieces integrally attached to a front panel together with automatic feeding of the slide fastener stringer from a continuous supply to a sewing machine has not lent itself to mechanization.

SUMMARY OF THE INVENTION

The object of the invention is to mechanize the attachment of a slide fastener stringer to a fly flap portion which has been cut integral with a main panel of a garment or the like and which is to be the covered fly flap in a completed fly structure.

Another object of this invention is to provide a machine which will clamp a main body panel having a fly flap portion integral therewith, place a slide fastener stringer in predetermined position thereon and feed the assembled items to a sewing machine to permanently secure the assembly together.

A further object is to provide a machine which will fold the fly flap portion of a garment to provide a pocket and insert one side of a slide fastener stringer in the pocket.

A still further object is to provide a machine for placing one side of a slide fastener stringer in position on a fly flap portion of a garment or the like and which machine precuts the desired length of slide fastener stringer from a continuous supply.

Another object of this invention is to provide a machine for folding a portion of a garment to provide a longitudinal slot in a predetermined position, inserting a predetermined length of a slide fastener stringer in the slot and permanently securing the folds together as well as securing the slide fastener stringer in said slot.

These and other objects and advantages of the present invention will become more readily apparent from the following detailed description of the preferred embodiments and from the accompanying drawings.

DESCRIPTION OF THE DRAWINGS AND PREFERRED EMBODIMENT

Figure 1:
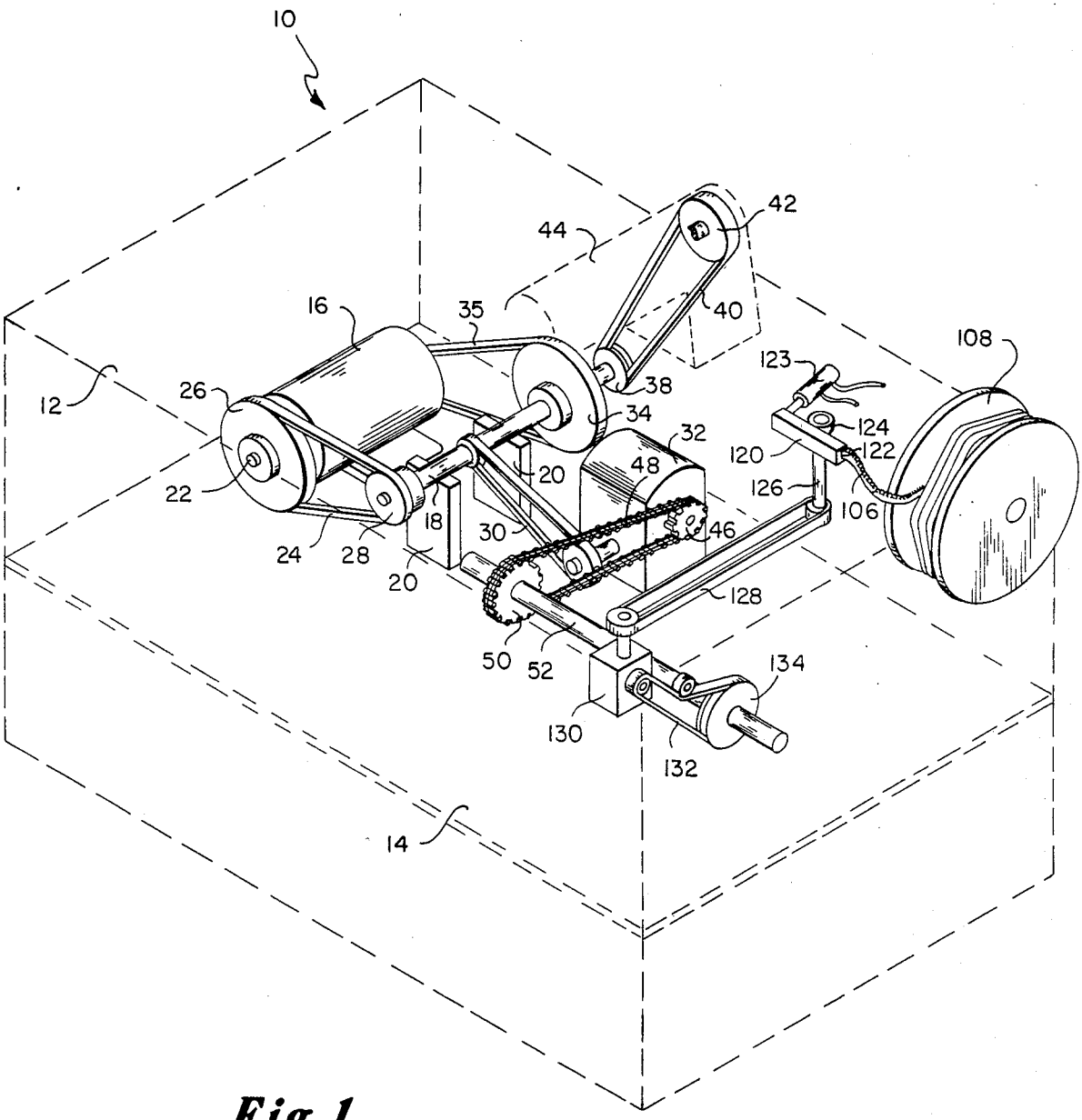
FIG. 1 is a perspective view of the machine of the present invention showing the main drive system and the zipper supply feed.

Referring now to FIG. 1 there is shown in dotted lines a cabinet generally indicated at 10 having an upper surface 12 and a lower shelf 14. Mounted on the shelf 14 is a motor 16 which provides the driving force for the various elements of the machine of the present invention.

A shaft 18 is mounted for rotation on a pair of blocks 20 on the shelf 14. The shaft 18 extends parallel to the shaft 22 of the motor 16 and is coupled to one end of the motor shaft 22 by means of a belt 24 passing around a pulley 26 mounted on the motor shaft 22 and a pulley 28 mounted through a conventional clutch on shaft 18.

Intermediate the blocks 20 a belt 30 connects the shaft 18 to the input shaft of a right angle gear box 32. A second pulley 34 is mounted on the shaft 18 by means of a conventional clutch and is connected by a belt 35 to a pulley mounted on the other end of the motor shaft 22. As can be seen the size of the pulleys 28 and 34 on the shaft 18 will vary as will the pulleys on the opposite ends of motor shaft 22 whereby the shaft 18 can be driven at different speeds depending on which pulley 18 or 34 is connected to shaft 18 by its respective clutch. A pulley 38 is fixed on the shaft 18 and is connected by means of a belt 40 to the driving pulley 42 connected by a suitable clutch to a sewing machine 44 mounted on the upper surface 12 of the cabinet 10.

Figure 2:
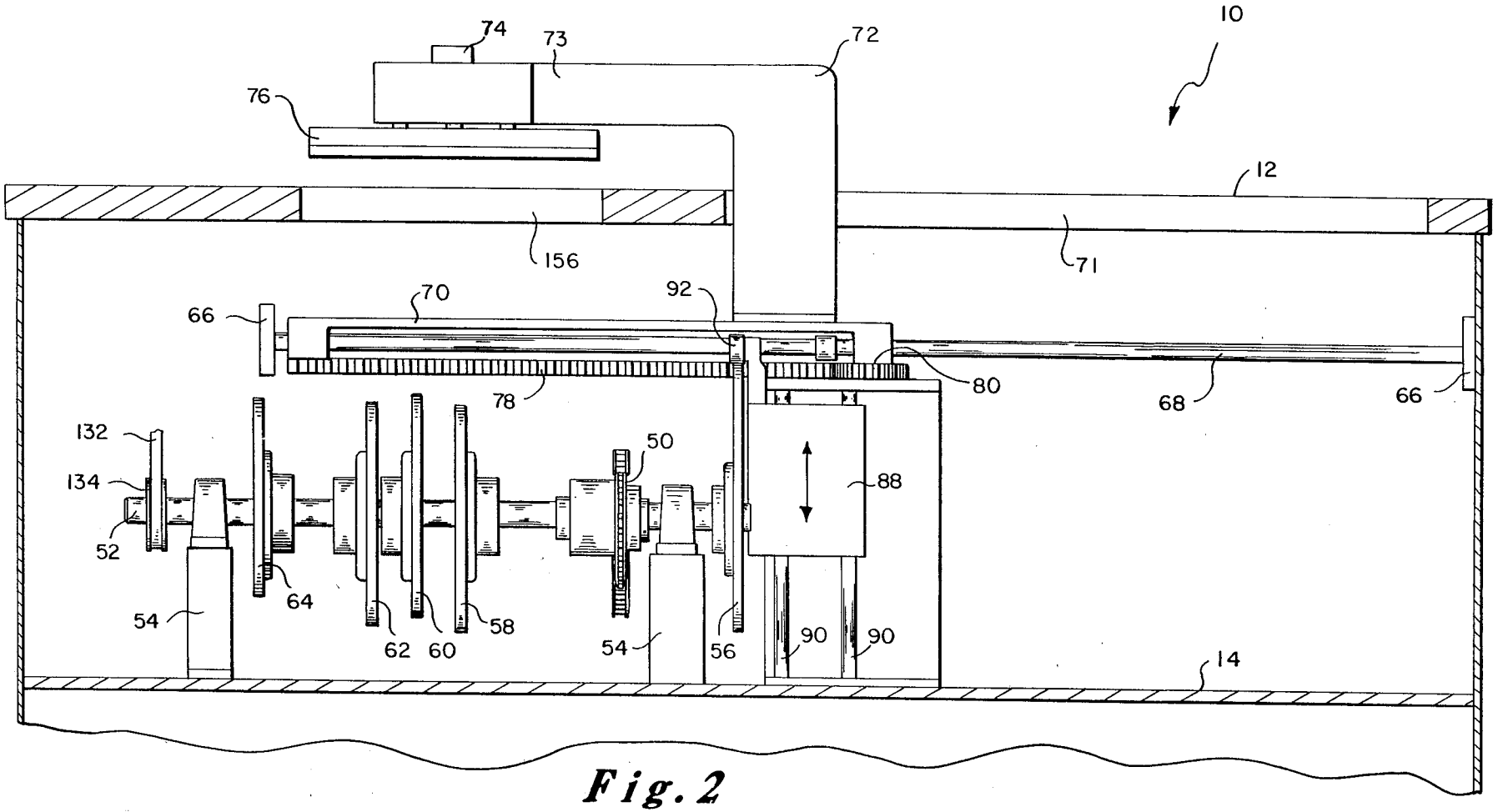
FIG. 2 is a elevation view showing the main cam shaft and the upper clamping member.

A sprocket 46 on the output shaft of the right angle gearbox 32 is connected by means of a chain 48 to a sprocket 50 fixedly mounted on a shaft 52 rotatably supported by bearing blocks 54 (see FIG. 2) on the shelf 14. As seen in FIG. 2, the shaft 52 has a plurality of cams 56, 58, 60, 62 and 64 fixedly mounted in spaced apart relation thereon for operating the various elements of the machine in predetermined timed relationship according to the contour of the cams.

Figure 3:
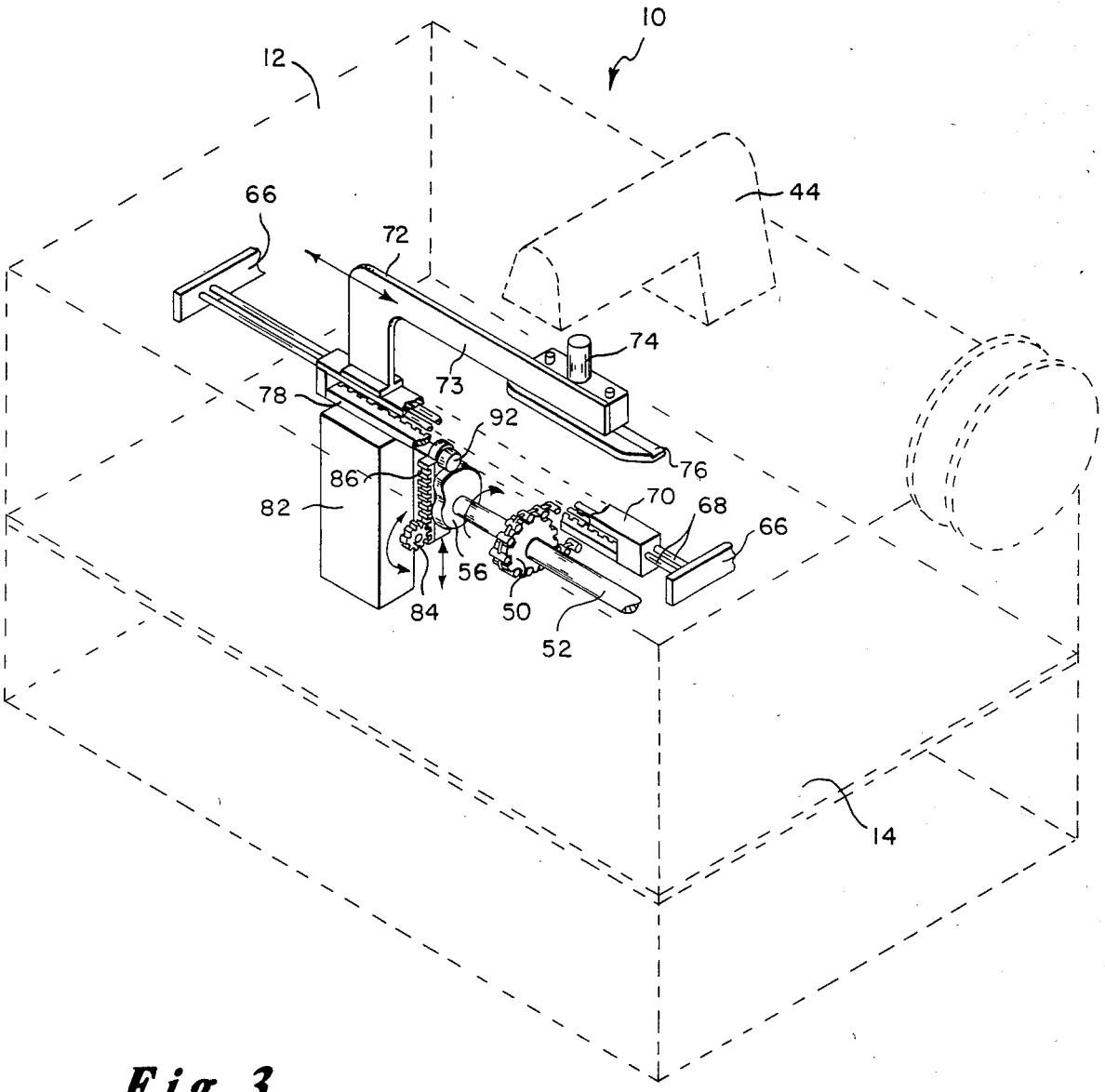
FIG. 3 is a perspective view showing the connections between the main cam shaft and the upper clamping member.

As seen in FIGS. 2 and 3 a pair of brackets 66 are mounted in a suitable manner inside the cabinet 10 adjacent the upper surface 12. Extending between the brackets 66 are a pair of parallel rods 68 on which is slidable mounted at its opposite ends a support 70. A vertical arm 72 is fixed to the support 70 adjacent one end thereof and extends upwardly through a slot 71 in the upper surface 12 and is provided with a horizotal arm 73 having a free end spaced above the upper surface 12. An air cylinder 74 or the like is mounted on the free end of arm 73 and has a clamp member 76 fixed to the piston rod thereof for movement toward and away from the upper surface 12 when pressure is supplied or removed from the upper end of the air cylinder 74.

A rack 78 is fixed to the underside of the support 70 and has its teeth engaged with a gear 80 on the output shaft of a right angle gear box 82. The input shaft of the gear box 82 has a gear 84 mounted thereon for engagement with the teeth of a rack 86 which is secured to a plate 88 slidably mounted on a pair of vertically disposed parallel rods 90. The rods 90 and the gear box 82 are mounted in fixed position on the shelf 14. A cam follower 92 is mounted on the plate 88 and engages the cam 56 mounted on the cam shaft 52. As the cam 56 is rotated by shaft 52 the cam follower 92 will move the plate 88 up and down and which movement through the racks and gears will thus move the support 70 lengthwise on the machine.

Figure 4:
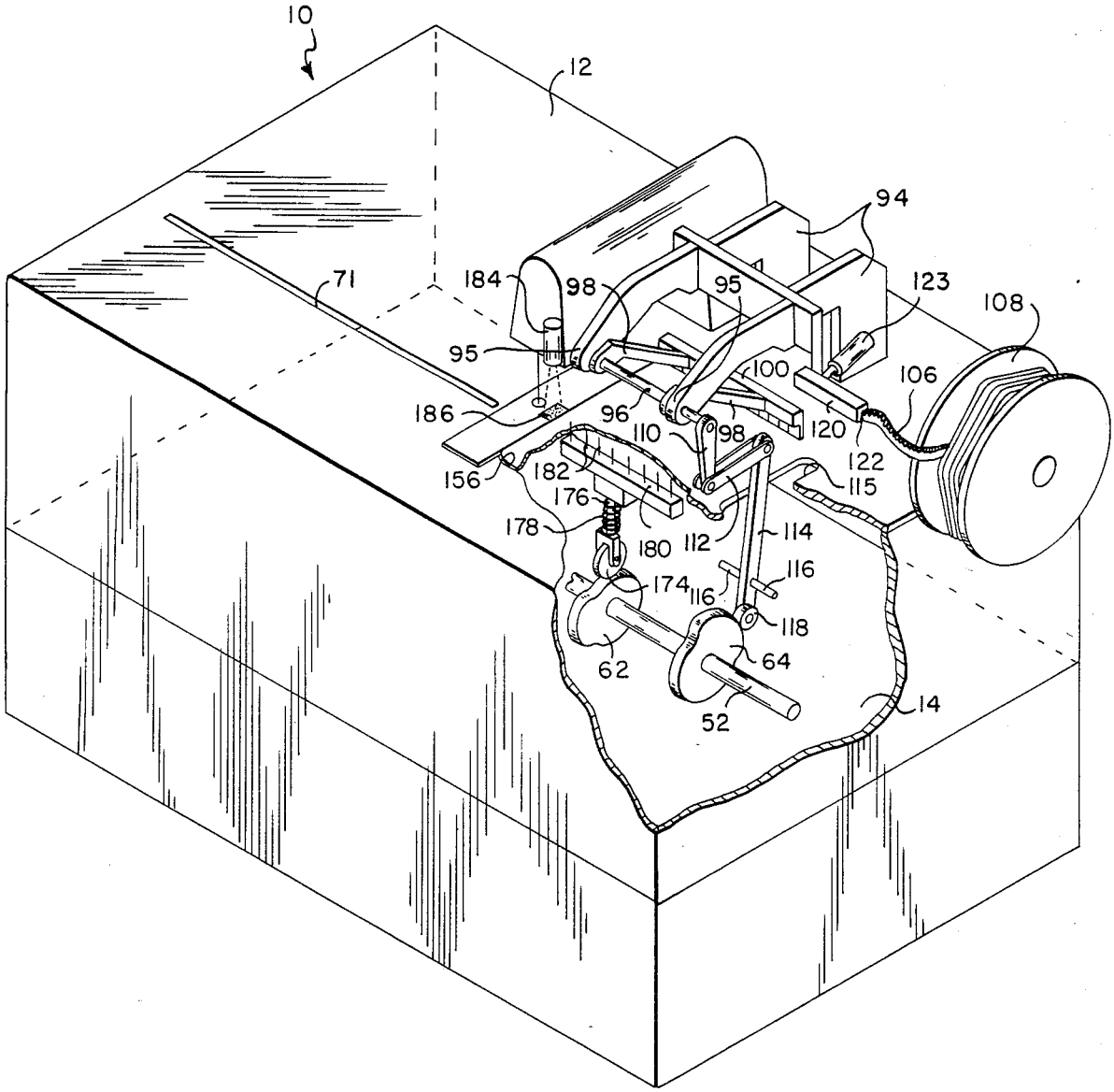
FIG. 4 is a perspective view showing the connections between the main cam shaft and the tucker member and the pin bar of the present invention.
Figure 8:
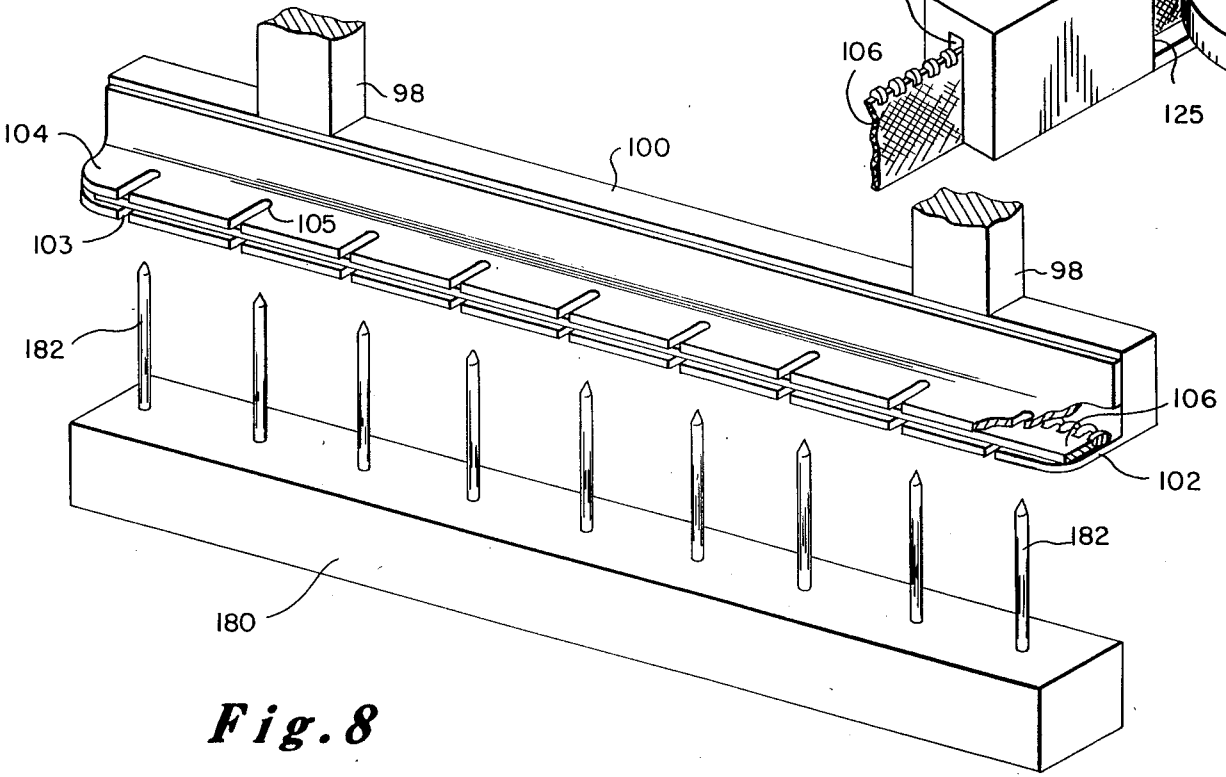
FIG. 8 is a enlarged exploded view of the pin bar and the tucker zipper inserter member.

As seen in FIG. 4, a pair of supports 94 extend upwardly from the upper surface 12 in fixed position. These supports 94 terminate in arms which overlie the surface 12 in spaced relation thereto and have free ends 95. A shaft 96 is rotatably supported on the free ends 95 of the arms. Fixed to the shaft 96 between the arms are the ends of a pair of legs 98 which legs 98 have their opposite free ends connected together by a bar 100. The bar 100 is provided with a lip 102, as seen in FIG. 8, extending from the bottom surface of the bar 100 in a direction away from the uprights 94. Secured in a suitable manner to the bar 100 in overlying relationship to the lip 102 is a resilient member 104 which forms with the lip 102 a slot for receiving one half of a slide fastener stringer 106 which is drawn from a supply 108 conveniently mounted on the cabinet 10. The slide fastener stringer 106 is placed in the slot with the slide fastener elements inwardly of the slot and with the tape edge located at the free edge of the lip 102 and resilient member 104, as best seen in FIG. 8. The lip 102 is provided with a plurality of slots 103 extending inwardly from the free edge thereof and the member 104 is provided with a plurality of slots 105 extending inwardly from the free edge thereof and in alignment with the slots 103 for a purpose to be described later.

Fixedly secured to the shaft 96 outwardly of the uprights 94 is an arm 110 connected by means of a link 112 to an arm 114 which passes through a slot 115 in the surface 12 and is pivotally connected intermediate its ends to a bracket (not shown) mounted on the underside of surface 12 by means of pins 116. The free end of the arm 114 supports a cam follower 118 in engagement with cam 64 mounted on shaft 52. Thus as cam 64 rotates with shaft 52, arm 114 will pivot about the pins 116 and this will cause the shaft 96 to rotate moving the bar 100 from a start position closely adjacent the underside of uprights 94 to a position adjacent the upper surface 12.

Figure 9:
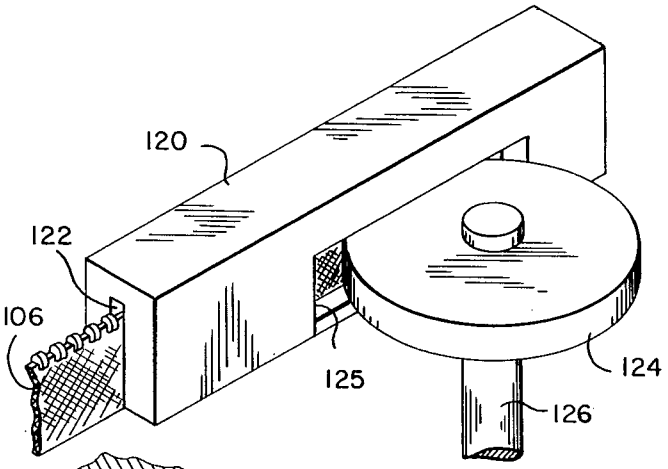
FIG. 9 is an enlarged view of the zipper feed mechanism.

Supported by the uprights 94 is a bar member 120 which is provided with a groove 122 which opens downwardly and which groove 122 receives the slide fastener with the slide fastener elements being disposed within the bar 120, as seen in FIG. 9. The bar 120 is mounted so that the groove 122 therein will register with the slot formed by lip 102 and resilient member 104 when the bar 100 is in start postion. The slide fastener stringer 106 can thus be fed from the supply 108 through member 120 and into the slot formed by lip 102 and member 104 when bar 100 is lined up with member 120. At the end of member 120 adjacent to bar 100 an air operated cutter 123 is mounted to sever the slide fastener tape 106 after a predetermined amount has been fed into the bar 100.

In order to feed the slide fastener stringer 106 through the member 120, one side of the member is provided with a cutout 125 into which the rim of a wheel 124 projects in engagement with the slide fstener stringer 106. Thus as the wheel 124 rotates with the rim thereof in engagement with the slide fastener stringer 106, the slide fastener stringer will be forced through member 120 and into the bar 100.

The wheel 124 is mounted at the top end of a shaft 126 mounted vertically on the upper surface 12 and passing through a hole 127 in the upper surface 12. The lower end of shaft 126 (see FIG. 1) is connected by means of a belt 128 to the output shaft of a right angle gear box 130. A belt 132 connects the input shaft of the gear box 130 to a pulley 134 which is connected to shaft 52 by means of a suitable clutch. Thus when the clutch is engaged to connect pulley 134 to the shaft 52, the wheel 124 will be driven to feed the slide fastener stringer 106 to bar 100. Disengagement of the clutch will stop the feed of the slide fastener stringer 106.

Figure 5:
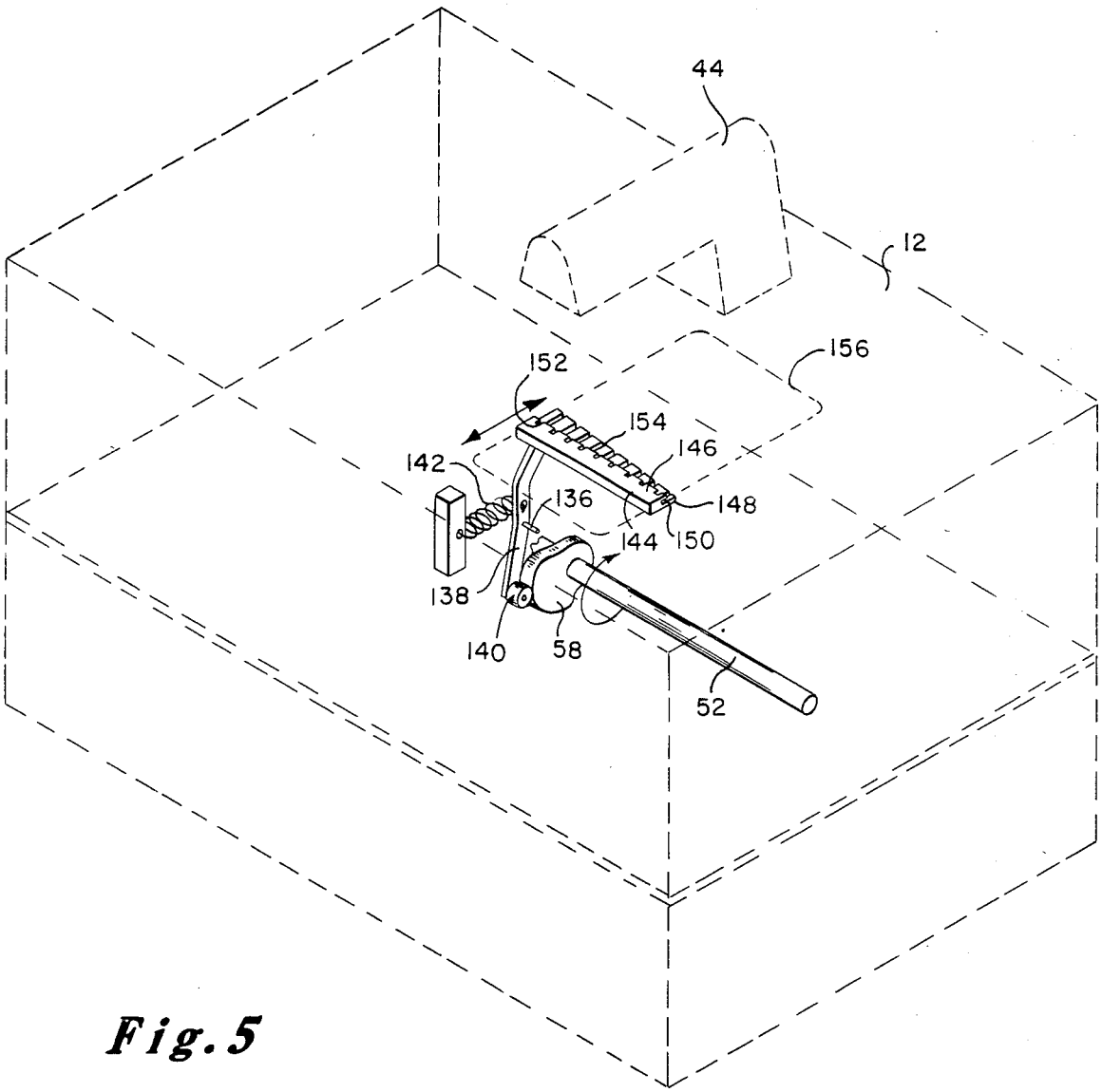
FIG. 5 is a perspective view of the connections between the main cam shaft and the front lower folding member.

Pivotally mounted on the machine by means of pins 136 supported in a bracket (not shown) is a substantially vertically disposed arm 138, having at its lower free end a cam follower 140 in engagement with cam 58 which is fixedly mounted on cam shaft 52 (see FIG. 5). A spring 142 is connected between the upper portion of arm 138 and the frame of the cabinet 10 and urges the cam follower 140 into engagement with cam 58. The upper end of arm 138 is connected to a plate 144 which forms the initial lower support for the garment panel when it is placed in the machine. The undersurface of the plate 144 is disposed slightly above the top surface of the cabinet top 12.

The plate 144 is provided with an upper lip 146 and a lower lip 148 extending in the direction of bar 100. The lower lip 148 extends a greater distance than the upper lip 146 and a recess 150 is formed between the lips with its opening facing the bar 100. A plurality of slots 152 extend inwardly from the free edge of the lip 146 as far as the closed end of the recess 150. Likewise the lip 148 is provided with a plurality of slots 154 extending inwardly from the free edge thereof and aligned with the slots 152. Thus as cam 58 rotates, the arm 138 will pivot on pins 136 and plate 144 will move back and forth just above one end of a cutout 156 in the upper surface 12 of the cabinet 10.

Figure 6:
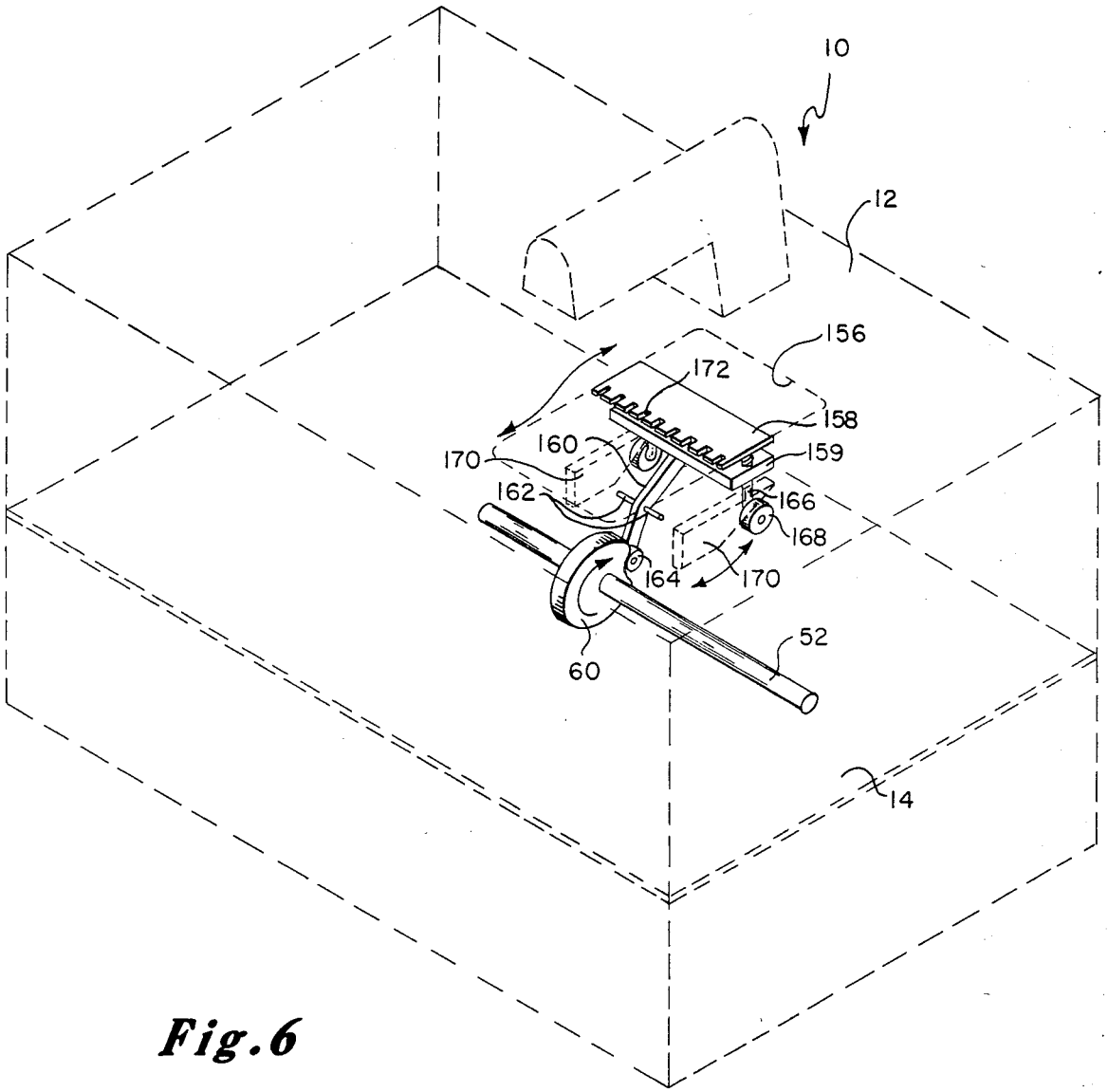
FIG. 6 is a perspective view of the connections between the main cam shaft and the rear underfolding member.
Figure 7:
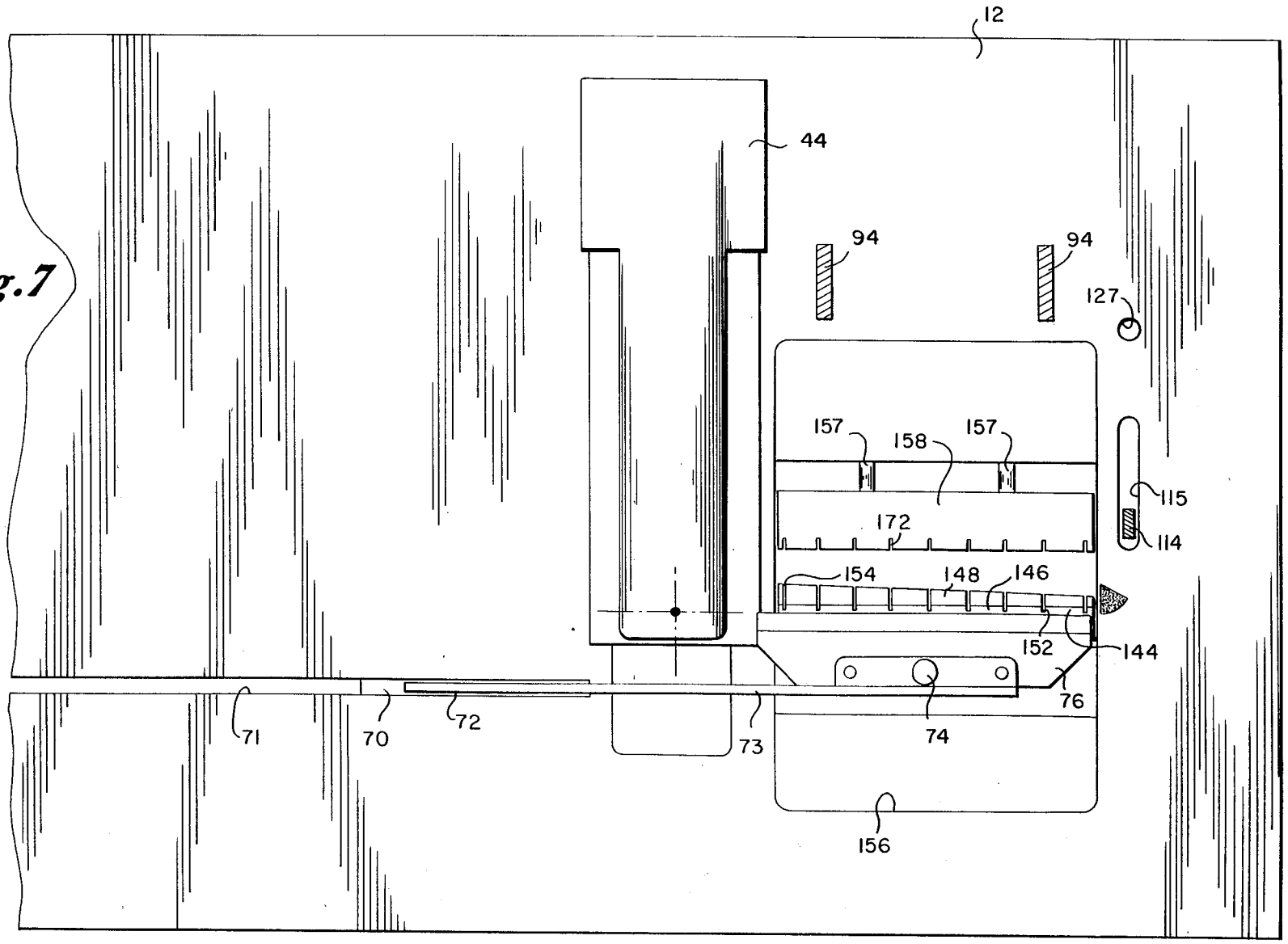
FIG. 7 is a top plan view showing the location of the various folding and clamping members as related to the sewing head.

Referring to FIG. 6, an underfolding clamp plate 158 is mounted in the cutout 156 for movement toward and away from the lower clamping member 144. A substantially vertically disposed arm 160 is mounted adjacent its mid point by means of pins 162 to a bracket (not shown) mounted in fixed position on the frame of the cabinet 10. The lower end of the arm 160 carries a cam follower 164 which is in engagement with the cam 60 mounted on the cam shaft 52. The upper end of the arm 160 is connected to a plate 159 mounted on a pair of parallel rods 157 (FIG. 7) so that as the cam 60 rotates the plate 159 will move toward and away from plate 144 in response to the pivotal movement of arm 160 on the pins 162. Suitable spring means can be utilized to retain cam follower 164 in engagement with cam 60.

The underfolding clamp plate 158 is mounted for up and down motion on plate 159 as the plate 159 moves toward and away from the plate 144. To this end the connection between the plate 159 and the underfolding clamp plate 158 comprises vertical rods (not shown) having springs thereon between the plates and which spring means urge the underfolding clamp plate 158 upwardly. In order to accomplish the down and up motion of underfolding clamp plate 158, an arm 166 is fixed to the underside of the underfolding clamp plate 158 and extends downwardly therefrom. The lower free end of arm 166 carries a cam follower 168 which is in engagement with a cam surface 170 fixed to the under surface of the top 12 of the cabinet. Thus as the plate 159 moves to the left as seen in FIG. 6, the follower 168 will ride down the ramp portion of cam 170 drawing the underfolding clamp plate 158 downwardly as it is moved to the left by plate 159. The upper surface of the underfolding clamp plate 158 will be even with the top of uppersurface 12 and the bed of the sewing machine 44 when the underfolding clamp plate is in its lowermost position due to the action of cam 170 and cam follower follower 168.

The underfolding clamp plate 158 is provided with a plurality of openings 172 along the edge which faces the plate 144 and these openings 172 are in alignment with the openings 152 and 154 in the lips of plate 144. These openings 172 may be in the form of slots or holes extending vertically completely through the underfolding clamp plate 158.

In engagement with cam 62 on the shaft 52 is a cam follower 174 (see FIG. 4). The cam follower 174 is mounted on the lower end of a rod 176 which is urged downwardly by a spring 178 to maintain the cam follower 174 in engagement with the cam 62. The upper end of rod 176 has a bar 180 mounted thereon for vertical movement with the rod 176. Extending upwardly from the bar 180 (see FIG. 8) are a plurality of pins 182 which are in alignment with slots 103, 105, 152, 154, and 172 enabling the pins to pass therethrough when the bar 180 is raised by cam 62 against the action of the spring 178.

Referring to FIG. 4, there is shown a sensor 184 mounted on the sewing machine head 44. The sensor 184 is of the type which directs a light beam against a reflective surface and receives the reflected signal. To this end a piece of reflective material 186 is mounted on the bed of the sewing machine 44 in line with the sensor 184. Thus as material is fed to the sewing machine 44 it will pass over the reflective material 186 interrupting the light beam. The sensor 184 is connected to the clutch for connecting the sewing machine 44 to the main drive and interruption of the beam will actuate the clutch to start the sewing machine 44. The sensor 184 is also connected to the clutch for driving the slide fastener stringer feed unit and this also will be actuated upon interruption of the light beam. The termination of the actuation of both of these clutches to stop the sewing and the feeding of the slide fastener stringer can be accomplished either by a separate timing device or when the material clears the reflective material 186 thereby clearing the light beam.

Figure 10:
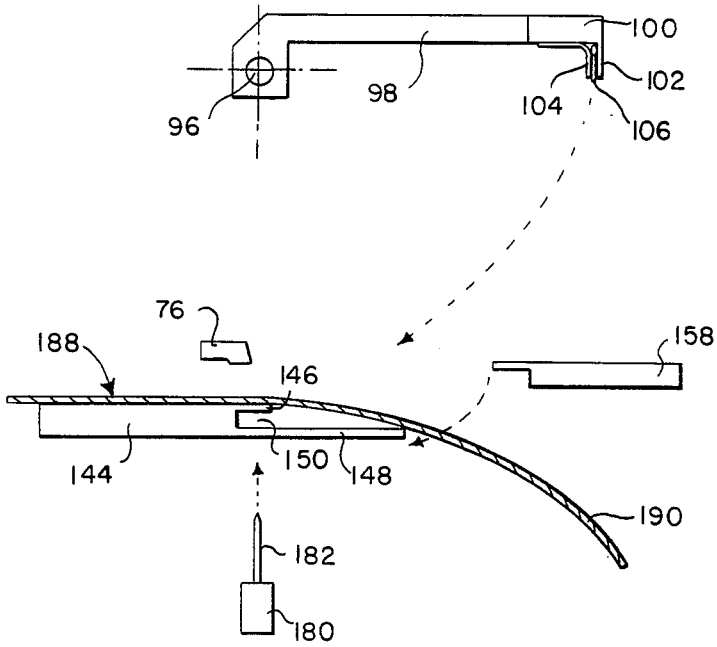
FIG. 10 shows the start position of the parts with the original placement of the garment panel.

Referring to FIGS. 10 to 16 the sequence of operation of the various elements forming the machine of the present invention are shown. As seen in FIG. 10, the various elements are shown in their start position. In this position the arm 98 is in a substantially horizontal position and a length of slide fastener stringer 106 has already been inserted in the jaws of the bar 100 during the sewing of the previous fly flap. With the elements in these positions the operator then places a garment panel 188 in the machine with the fly flap portion 190 as shown in FIG. 10.

Figure 11:
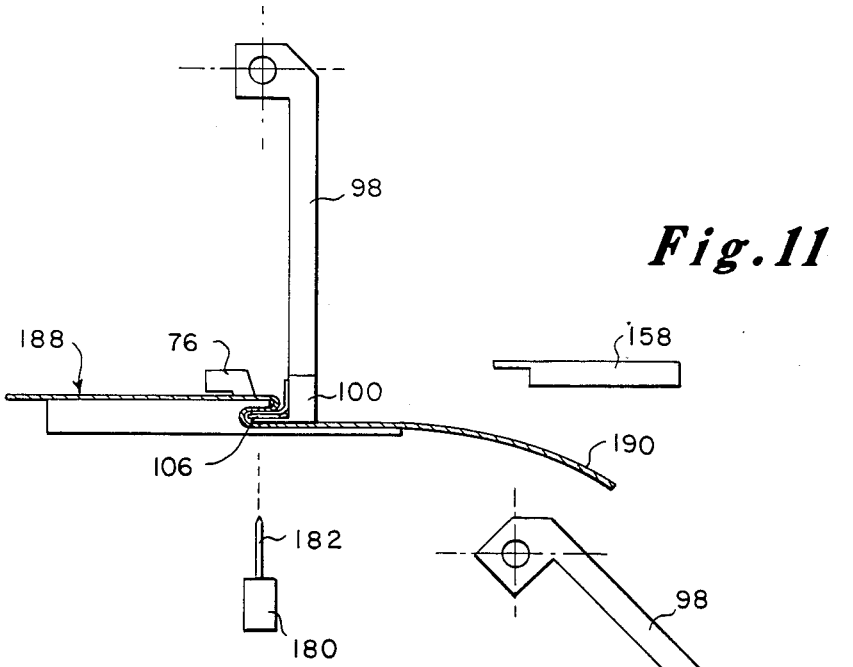
FIG. 11 shows the position taken by the garment panel after the tucker-zipper inserter has been actuated and prior to actuation of the rear lower clamping member.
Figure 12:
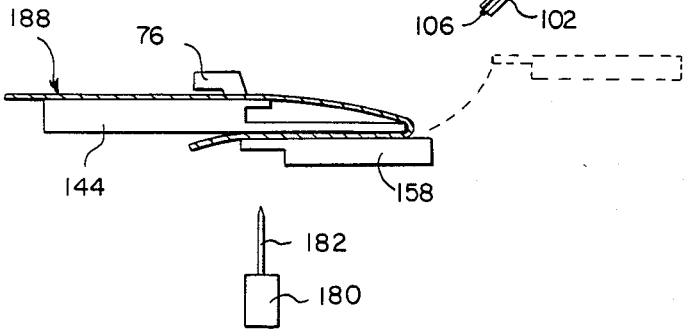
FIG. 12 shows an alternate form in which the rear lower clamping member moves prior to the tucker-zipper inserter.
Figure 13:
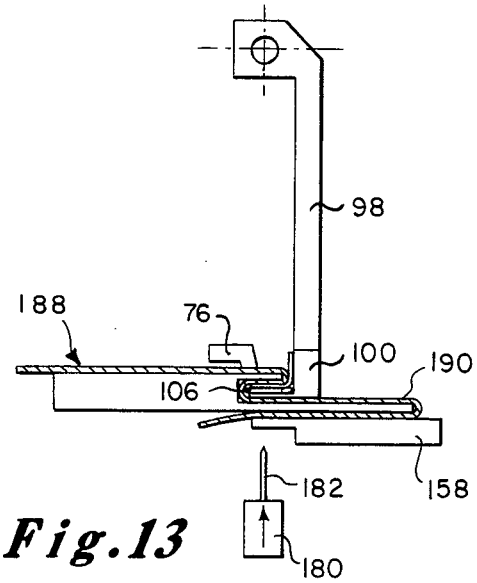
FIG. 13 shows the position taken by the garment panel at the completion of the movement of the rear lower clamping member and tucker-zipper inserter.
Figure 14:
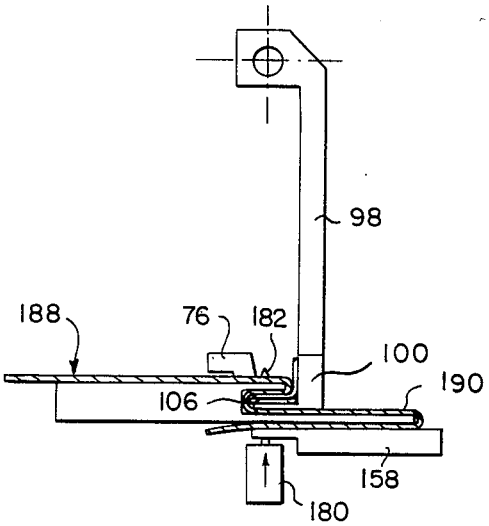
FIG. 14 shows the movement of the pin bar to impale the garment folds and the zipper.
Figure 15:
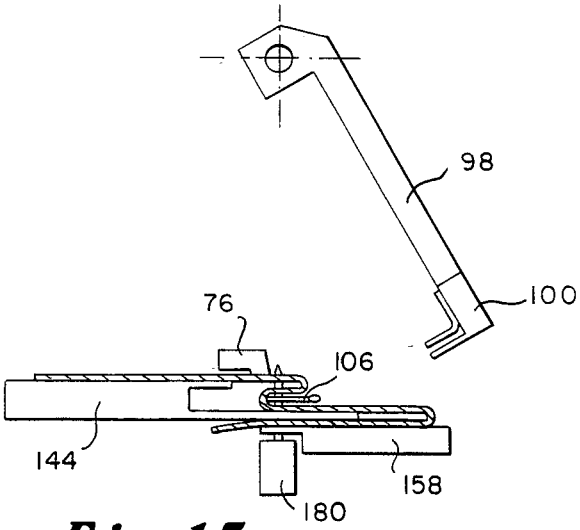
FIG. 15 shows the withdrawal of the tucker-zipper inserter and the front lower clamping member.
Figure 16:
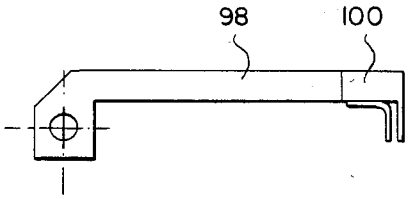
FIG. 16 shows the withdrawal of the pin bar.
Figure 16:
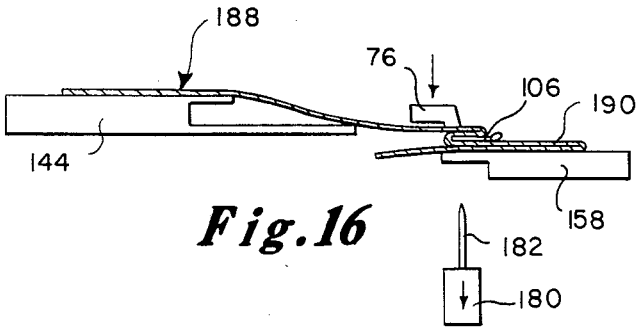

The operator then starts the machine and the upper clamp plate 76 first descends to clamp the garment panel to the upper level 146 of the lower clamp plate 144. The arm 98 swings down in an arc and the leading edge of the jaws on bar 100 engage the fly flap portion 190 and force it into the recess 150 in the lower clamping member 144 as shown in FIG. 11. The underfolding clamp plate 158 then moves downwardly and beneath the lower clamp plate 144 to fold the free edge of the fly flap portion 190 under the lower lip 148 of the lower clamping member 144. If desired the timing of the operation can be varied to allow the underfolding clamp plate 158 to arrive in position prior to the jaws on bar 100 engaging the fly flap portion 190 as seen in the alternate form shown in FIG. 12. In either case the positioning and structure of FIG. 13 will be achieved.

At that point the pin bar 180 will rise with the pins 182 passing through the various aligned slots impaling the folds in the fly flap portion 190 together with the slide fastener stringer 106 to maintain these items in fixed position. The arm 98 is then swung back to its horizontal position with the groove in the bar 100 in line with the groove in member 120. At the same time the lower clamping member 144 is withdrawn leaving the folds and slide fastener stringer 106 impaled on the pins 182. The clamp plate 76 is again actuated to move it futher downwardly toward the underfolding clamp plate 158 thereby clamping the folds and the slide fastener stringer 106 in position. At that point the pins 182 are withdrawn leaving the upper clamp plate 76 and the underfolding clamp member 158 gripping the folded structure.

The upper clamp plate 76 is now moved lengthwise along the underfolding clamp plate 158 thus sliding the folded structure toward the sewing machine 44 on the bed thereof which is at the same level as the upper surface of the underfolding clamp plate 158. When the leading edge of the fly flap panel 190 arrives at sensor 184 it interrupts the light beam and it starts the sewing machine 44 as well as the wheel 124 which feeds the slide fastener strip 106 to bar 100. The sewing operation and feeding of the slide fastener to bar 100 is continued until it has been stopped either by the material clearing the sensor or by a separate timing device and on stopping the cutter 123 will be actuated to sever the new length of slide fastener strip 106 which has been fed from the supply 108.

The upper clamp plate 76 is now raised enabling the garment panel 188 to be removed from the machine and both the upper clamp plate 76 and the underfolding clamp plate 158 are returned to the start position shown in FIG. 10.

It is understood that the invention is not limited to the embodiments shown and described, but many changes and modifications can be made without departing from the invention as defined in the appended claims.

What is claimed is:

1. In a machine for forming one half of a fly structure on a garment panel having a fly flap portion integral therewith comprising, first and second stations on said machine, clamp means at said first station for initially clamping said garment panel adjacent the juncture line of the fly flap and main body portion in a predetermined position on said machine, tucking means at said first station for forming a slit type pocket along the juncture line of the fly flap and main body portion of said garment panel and inserting the tape portion of one half of a slide fastener stringer in said pocket, underfolding means at said first station for folding under the free edge of the fly flap portion, holding means at said first station for retaining said slide fastener stringer in said pocket, a portion of said clamp means cooperating with said underfolding means to transfer said garment panel to said second station while retaining said slide fastener stringer in said pocket, and securing means located at said second station for permanently attaching the tape portion of the slide fastener in said pocket.

2. In a machine according to claim 2 wherein, said clamp means includes and upper clamping member and a lower clamping member, said lower clamping member having two levels with the lower level extending beyond the upper level, and a recess formed under said upper and above said lower level adapted to receive a U-shaped section of the fly flap portion.

3. In a machine according to claim 2 wherein, said tucking means comprises an arm pivotally mounted on said machine for movement toward and away from said clamp means, said arm having retaining means on the free end thereof and adapted to receive the tape portion of a slide fastener stringer therebetween with the slide fastener elements being disposed between the closed end of the jaws, and said jaws having the free ends thereof being adapted to enter the recess between the upper and lower levels of the lower clamping member.

4. In a machine according to claim 3 wherein, said retaining means comprises a pair of jaws on said arm, and at least one of said jaws being resiliently mounted to permit withdrawal of the slide fastener stringer in a direction transverse to the length of the slide fastener stringer.

5. In a machine according to claim 3 wherein, said underfolding means comprises a plate mounted on said machine for movement toward and away from said clamp means, said plate having a start position vertically disposed above said lower clamping member of said clamp means and horizontally spaced therefrom, and said plate having a movement vertically downward as it moves toward said lower clamping member to enable it to move under said lower clamping member to fold and clamp the free edge of the fly flap portion under the lower clamping member and retain it in folded position.

6. In a machine according to claim 5 wherein, said holding means comprises a bar mounted on the machine in predetermined position under said lower clamping member, a row of pins mounted on said bar in spaced apart relation with the free ends of said pins extending upwardly from said bar, said bar being moveble vertically toward and away from said lower clamping member, each of said levels of said lower clamping member being provided with aligned slots in line with said pins and extending toward the free edge of the said lower level, said jaws on said tucking means being provided with slots in line with said pins and extending toward the free edge of said jaws, and said plate being provided with spaced apertures adjacent one edge thereof in line with said pins whereby said pins can pass through said lower clamping member, said tucking means and said underfolding means and impale the folds of the material and the tape portion of the slide fastener stringer.

7. In a machine according to claim 6 wherein, said upper clamping member cooperates with said plate to support said folded garment section as said lower clamping means and said jaws are withdrawn while the pins remain in the garment folds, said upper clamping means being movable downwardly to clamp said folds and slide fastener tape against said plate while said pins are withdrawn, and said upper clamping means being movable from said first station to said second station while in lowered position to slide said folded garment from said plate to said second station while retaining the folds therein with said slide fastener tape in the pocket formed by the folds.

8. In a machine according to claim 7 wherein, said securing means at said second station is a sewing machine, and said upper clamping member feeds the folded garment section through the stitiching instrumentalities of said sewing machine.

9. In a machine for forming one half of a fly structure on a garment panel having a fly flap portion integral therewith comprising, a first station, a second station spaced from said first station, means at said first station for folding said fly flap portion in a predetermined manner and locating a slide fastener strip on said fly flap portion, clamp means moveable between said first and second stations for clamping the fold and slide fastener strip at said first station and then transferring said garment and slide fastener strip to said second station while retaining the fold and the slide fastener strip in position, and means at said second station securing said folds and said slide fastener strip in permanent position.

10. In a machine according to claim 9 wherein, said folding means comprises a bottom clamp member having two levels of unequal length with a recess under the top level, and a tucker member for deflecting a portion of the garment panel into said recess to form a slit type pocket in said panel.

11. In a machine according to claim 10 wherein, said tucker member is provided with means for receiving one half of a slide fastener strip and inserting it in the pocket as the pocket is formed.

12. In a machine according to claim 11 wherein, said folding means includes a plate for engaging the free edge of the garment panel and folding it under the lower level of said bottom clamp member.

13. In a machine according to claim 12 wherein, pin means are provided for impaling the folded under portion, the pocket forming folds and the slide fastener strip, and said bottom clamp member, said tucker member and said plate are provided with aligned apertures to permit said pin means to pass therethrough while the garment panel is clamped thereby.

14. In a machine according to claim 13 wherein, said folding means includes an upper clamp member for initially clamping the garment panel on said bottom clamp member, said upper clamp member cooperating with said plate member to clamp the folds and the slide fastener strip on the pin means while said bottom clamp member and said tucker member are withdrawn, and said upper clamp member being movable from said first station to said second station while clamping down on said folded garment panel to transfer said folded garment panel to said second station after said pin means are withdrawn.

15. In a machine according to claim 14 wherein, sewing means are provided at said second station, and said upper clamp member feeds the folded garment panel through the stitching instrumentalities of said sewing machine.

16. In a machine for securing a predetermined length of slide fastener tape to a garment panel comprising, a first station at which the slide fastener tape is placed in position on the garment panel, a second station spaced from said first station at which is located a sewing machine for securing said slide fastener tape to the garment panel by stitching, transfer means for clamping the garment panel and the slide fastener tape at the first station and then transporting the garment panel and the slide fastener tape from said first station to said second station, and sensing means at said second station indicating the arrival of said garment panel to start the sewing machine.

17. In a machine according to claim 16 wherein, said machine is provided with indicating means for stopping the operation of said sewing machine after a predetermined length of stitching has been achieved.

18. In a machine according to claim 17 wherein, a slide fastener tape feeding means is located at said first station for withdrawing slide fastener tape from a supply roll, said slide fastener tape feeding means being actuated by said sensing means, and said slide fastener tape feeding means being stopped by said indicating means.

19. In a machine according to claim 18 wherein, said slide fastener tape feeding means includes a cutter which is actuated upon stopping of said slide fastener tape feeding means to sever the just fed slide fastener tape from the supply roll.

20. In a machine for securing a predetermined length of slide fastener tape to a garment portion comprising, clamping means for holding the garment portion in position on the machine, folding means for forming an S-shaped fold in said garment portion, said folding means including inserting means for placing a predetermined length of slide fastener tape in said S-shaped fold, and securing means for permanently attaching said slide fastener tape in said S-shaped pocket.

21. In a machine according to claim 20 wherein, said folding means includes a first member on which said garment portion is clamped, said first member being provided with upper and lower lips, a recess extending inwardly above said lower lip and under said upper lip, and a tucking member having retaining means carrying said slide fastener tape adapted to enter said recess whereby said garment portion is doubled into said recess forming an S-shaped pocket with the slide fastener tape positioned therein.

22. In a machine according to claim 21 wherein, said folding means includes gripping means for retaining said S-shaped pocket and said slide fastener tape in position while said first member and said tucking member are withdrawn.

23. In a machine according to claim 22 wherein, said gripping means includes a series of pins mounted in spaced apart relationship on a bar located beneath said first member and movable vertically to impale said S-shaped pocket and said slide fastener tape, and said first member and said tucking member are provided with aligned slots permitting passage of said pins and permitting withdrawal of the said first member and said tucking member after said pins have entered said S-shaped pocket and said slide fastener tape.

24. In a machine according to claim 23 wherein, said folding means includes and underfolding plate mounted for horizontal movement to a position under said first member, said underfolding plate forming a bottom support for said S-shaped pocket and said slide fastener tape upon withdrawal of said first member and said tucking member, and said underfolding plate being provided with apertures allowing the passage of said pins therethrough.

25. In a machine for securing a length of slide fastener tape to a garment panel comprising a first station at which the slide fastener tape is placed in predetermined position on the garment panel, a second station at which is located a sewing machine for securing said slide fastener tape to the garment panel by stitching, and transfer means for clamping the garment panel and the slide fastener tape in fixed relative position to each other at said first station and then transporting the garment panel and the slide fastener tape from said first station to said second station.

26. In a machine according to claim 25 wherein, said transfer means is the sole feeding means for moving the garment panel and slide fastener tape through the sewing machine during stitching.

27. In a machine according to claim 25 wherein, underfolding means are provided at said first station for doubling under a portion of said garment panel.

28. In a machine according to claim 27 wherein, said transfer means is the sole feeding means for moving the garment panel and slide fastener tape through the sewing machine during stitching.

* * * * *